US011274420B2

(12) United States Patent
An

(10) Patent No.: US 11,274,420 B2
(45) Date of Patent: Mar. 15, 2022

(54) CONSOLE BOX FOR EXCAVATOR

(71) Applicants: Gugsoo An, Changwon-si (KR); Youngmin Ahn, Changwon-si (KR); Yelim Ahn, Gimhae-si (KR)

(72) Inventor: Gugsoo An, Changwon-si (KR)

(73) Assignees: Gugsoo An, Changwon-si (KR); Youngmin Ahn, Changwon-si (KR); Yelim Ahn, Gimhae-si (KR)

( * ) Notice: Subject to any disclaimer, the term of this patent is extended or adjusted under 35 U.S.C. 154(b) by 266 days.

(21) Appl. No.: 16/732,875

(22) Filed: Jan. 2, 2020

(65) Prior Publication Data

US 2021/0002869 A1 Jan. 7, 2021

(30) Foreign Application Priority Data

Jul. 2, 2019 (KR) ..... 10-2019-0079117

(51) Int. Cl.

| | |
|---|---|
| ***E02F 9/24*** | (2006.01) |
| ***G05G 5/00*** | (2006.01) |
| ***E02F 9/20*** | (2006.01) |
| *G05G 1/04* | (2006.01) |

(52) U.S. Cl.

CPC ..... *E02F 9/24* (2013.01); *E02F 9/20* (2013.01); *E02F 9/2004* (2013.01); *G05G 5/005* (2013.01); *G05G 1/04* (2013.01); *G05G 2505/00* (2013.01)

(58) Field of Classification Search

CPC ..... E02F 9/24; E02F 9/2004; E02F 9/2012; E02F 9/20; G05G 1/04; G05G 5/005; G05G 2505/00; B62D 51/002

See application file for complete search history.

(56) References Cited

U.S. PATENT DOCUMENTS

| | | | | | |
|---|---|---|---|---|---|
| 3,715,002 | A * | 2/1973 | Halls | G05G 5/08 | 180/271 |
| 4,008,626 | A * | 2/1977 | Schulte | B60K 20/02 | 74/491 |
| 4,507,601 | A * | 3/1985 | Andresen | G05G 7/04 | 323/330 |
| 4,526,055 | A * | 7/1985 | Batchelor | E02F 9/2004 | 137/636.2 |
| 5,050,700 | A * | 9/1991 | Kim | B60T 7/02 | 180/268 |
| 5,237,888 | A * | 8/1993 | McCombs | B62D 49/0692 | 192/96 |
| 5,664,637 | A * | 9/1997 | Ohta | E02F 9/2004 | 180/272 |

(Continued)

FOREIGN PATENT DOCUMENTS

| | | | |
|---|---|---|---|
| JP | 2004-245025 | A | 9/2004 |
| KR | 10-1998-0009677 | A | 4/1998 |

(Continued)

OTHER PUBLICATIONS

Korean Decision to Grant Patent dated Aug. 12, 2019, in connection with the Korean Patent Application No. 10-2019-0079117.

*Primary Examiner* — Paul N Dickson
*Assistant Examiner* — Timothy Wilhelm
(74) *Attorney, Agent, or Firm* — Hauptman Ham, LLP

(57) ABSTRACT

The present invention relates to a console box for an excavator to prevent malfunction and to be automatically moved to a designated position.

5 Claims, 11 Drawing Sheets

(56) References Cited

U.S. PATENT DOCUMENTS 5,860,488 A * 1/1999 Kim ..... B66F 9/20 180/271
6,835,148 B2 * 12/2004 Takebayashi ..... B62M 9/132 474/70
6,971,279 B2 * 12/2005 Jo ..... E02F 9/2004 180/269
7,165,472 B2 * 1/2007 Jo ..... E02F 9/2004 180/271
7,823,680 B2 * 11/2010 Yoon ..... B66F 9/0759 180/271
7,900,737 B2 * 3/2011 Isogai ..... B60T 7/06 180/305
8,038,202 B2 * 10/2011 Ueda ..... B66C 13/56 296/190.08
8,039,769 B2 * 10/2011 Asp ..... E02F 9/24 200/61.62
9,481,979 B2 * 11/2016 Hiraoka ..... E02F 9/0808
10,066,366 B2 * 9/2018 Yukawa ..... E02F 9/0833
10,328,798 B2 * 6/2019 Yasunobe ..... F16H 61/24
10,407,871 B2 * 9/2019 Nishigori ..... E02F 9/2012
10,597,851 B2 * 3/2020 Isaka ..... F16F 7/00
10,612,211 B2 * 4/2020 Yuan ..... G05G 5/005
10,800,489 B2 * 10/2020 Takayanagi ..... B62K 23/02
11,136,792 B2 * 10/2021 Jeong ..... E05B 79/20
2008/0316016 A1 * 12/2008 Yoon ..... E02F 9/24 340/532
2010/0186533 A1 * 7/2010 Akahane ..... G05G 5/005 74/483 R
2020/0224465 A1 * 7/2020 Nagaoka ..... E05B 81/06
2020/0248432 A1 * 8/2020 Akahane ..... G05G 1/62

FOREIGN PATENT DOCUMENTS

KR 20-0150161 Y1 7/1999
KR 10-2006-0092619 A 8/2006
KR 10-2014-0123120 A 10/2014

* cited by examiner

CONSOLE BOX FOR EXCAVATOR

CROSS REFERENCE TO RELATED APPLICATION

This application claims priority from Korean Patent Application No. 10-2019-0079117, filed on Jul. 2, 2019, which is hereby incorporated by reference for all purposes as if fully set forth therein.

BACKGROUND OF THE INVENTION

Field of the Invention

The present invention relates to a console box for an excavator, and more particularly, to a console box with a simple structure to operate an excavator, in which a safety lever for operating an operation lever which operates the excavator can be automatically operated or released according to the on/off signal of a power for the excavator or separate manipulation, thereby preventing malfunction of the operation lever, and in which a console housing having the safety lever can be automatically rotated at a desired angle, or can be automatically moved to a desired position, according to the on/off signal of the power for the excavator or separate manipulation, so that tan operator can easily get in or off the excavator.

Background of the Related Art

In general, a cabin for a construction machine is provided with an arm rest on a console box, and an operator rests his or her arm on the arm rest. Operation levers, for example, a joystick, for controlling the construction machine are installed on the console box with the armrest.

The console box of the related art is not movable with respect to an operator's seat, and thus it is hard for an operator to get in or off the cabin of the construction machine, due to a narrow space in the cabin. In addition, there is another problem in that in the case where the construction machine is operating, the operator may touch any one of operation levers installed to the console box while the operator is getting on or off the cabin.

In order to solve the above problems, a safety device for operation levers which are installed to a cabin controller of an excavator is disclosed in Korean Utility Model No. 20-0150161, the safety device including: a drive motor mounted below the operation levers; a tensile cable wound around a reel which is mounted to a shaft of the drive motor; and a telescopic safety lever consisting of concentric tubular sections to slide into another, in which the safety lever is extended by a certain length by operation of the drive motor to prevent an operator from leaving from an operator's seat, and is retracted by the cable which is wound around the reel, due to a restoring force thereof, at the operation of the drive motor.

However, the safety device of the related art can prevent the operator from touching any one of the operation levers while the operator is getting on or off the cabin, but still has a problem in that because of the console box of a big volume, the operator cannot easily get in or off the cabin.

Accordingly, there is required for a console box for an excavator capable of solving the above problem.

SUMMARY OF THE INVENTION

Therefore, the present invention has been made in view of the above problems, and an object of the present invention is to provide a console box with a simple structure to operate an excavator, in which a safety lever for operating an operation lever which operates the excavator can be automatically operated or released according to the on/off signal of a power for the excavator or separate manipulation, thereby preventing malfunction of the operation lever, and in which a console housing having the safety lever can be automatically rotated at a desired angle, or can be automatically moved to a desired position, according to the on/off signal of the power for the excavator or separate manipulation, so that tan operator can easily get in or off the excavator.

In order to achieve the above object, according to one aspect of the present invention, there is provided a console box for operating an excavator including: a plate-shaped stationary part which is fixed to a cabin; a console housing which is disposed on the stationary part to be spaced apart from the stationary part, and has a receiving space therein, of which an operation lever for manipulating the excavator is provided on an upper portion of the console housing, and a lower portion is rotatably connected to the stationary part at a rear side of the lower portion; a safety lever motor which is provided in the console housing to supply a rotational force; a motor gear which is connected to the safety lever motor to receive the rotational force from the safety lever motor; a safety lever gear which is connected to the motor gear to receive the rotational force and is provided on one side with a lever spring fixture extending to an outside; a lever spring which is engaged to the lever spring fixture of the safety lever gear and the console housing at both ends thereof to supply tension; a cylindrical safety lever cam which is connected to the safety lever gear by a shaft, of which an outer peripheral surface is provided with a cam groove; a pair of first and second sensors which are installed on the outer peripheral surface of the safety lever cam at a certain interval to detect the cam groove of the safety lever cam; a cylindrical safety lever connecting shaft which is rotatably connected to the safety lever cam and extends in one direction; a safety lever which is provided on one side of the console housing in the shape of a cantilever to be held by a hand, and is connected to the safety lever connecting shaft at one end thereof; a console motor which is provided on the stationary part to supply the rotational force and has a console motor gear; a fan-shaped console gear which is installed to the rear lower portion of the console housing and is provided on an outer peripheral surface thereof with gear teeth corresponding to the console motor gear, so that the rotational force of the console motor is transferred to the console gear via the console motor gear to rotate the console housing; a cylindrical console cam which is provided on the rear lower portion of the console housing and is connected to the console housing by the cylindrical console shaft, of which an outer peripheral surface is provided with a console cam groove; first and second console sensors which are respectively provided on upper and lower portions of the console cam to detect the console cam groove of the console cam; and a controller which is provided on the console housing to receive signals from the first and second sensors and the first and second console sensors, as well as receiving an ON/OFF signal from a power of the excavator, to control the safety lever motor and the console motor.

With the console box for the excavator according to the present invention, the safety lever for operating the operation lever which operates the excavator can be automatically operated or released under the control of the controller, or according to the on/off signal of the power for the excavator, thereby preventing malfunction of the operation lever. In addition, the console housing is automatically rotated at a desired angle, or is automatically moved to a desired position, under the control of the controller, or according to the on/off signal of the power for the excavator, so that the operator can easily get in or off the excavator.

DETAILED DESCRIPTION OF THE PREFERRED EMBODIMENT

Figure 1:
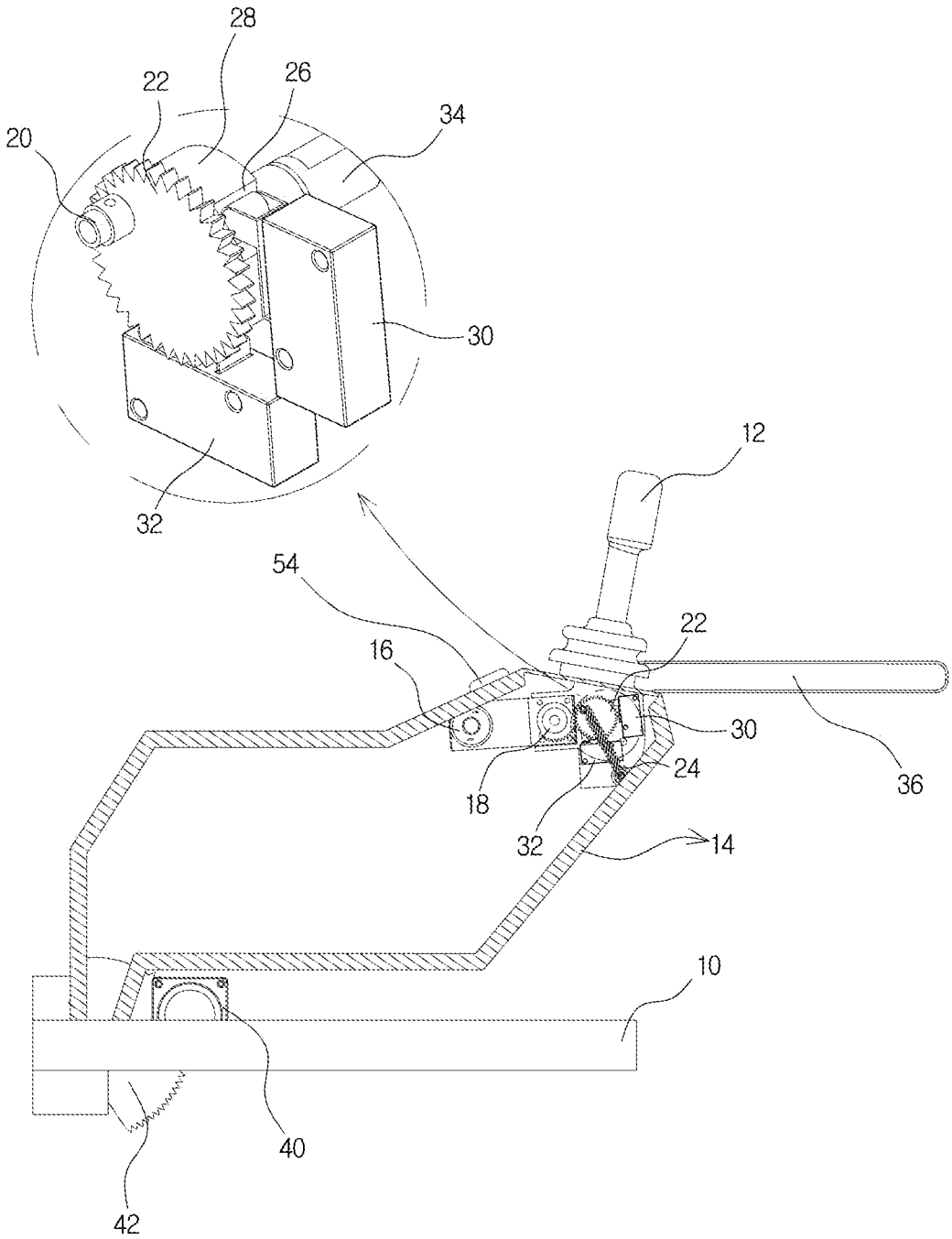
FIG. 1 is a cross-sectional view schematically illustrating a console box for an excavator according to the first embodiment of the present invention.
Figure 2:
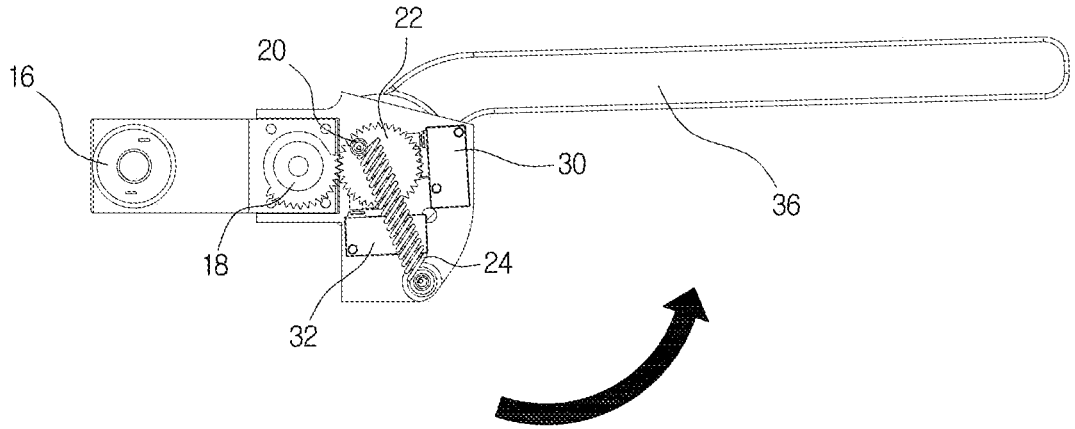
FIGS. 2 and 3 are views schematically illustrating some components of the console box for the excavator according to the first embodiment of the present invention.
Figure 3:
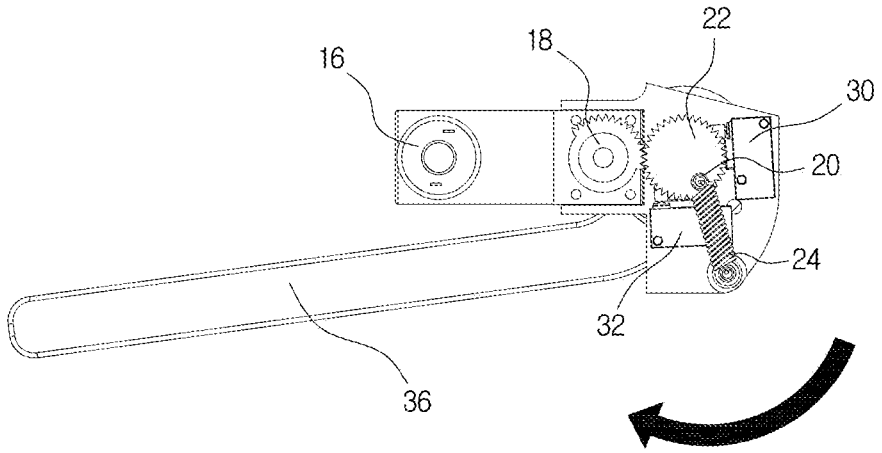
Figure 4:
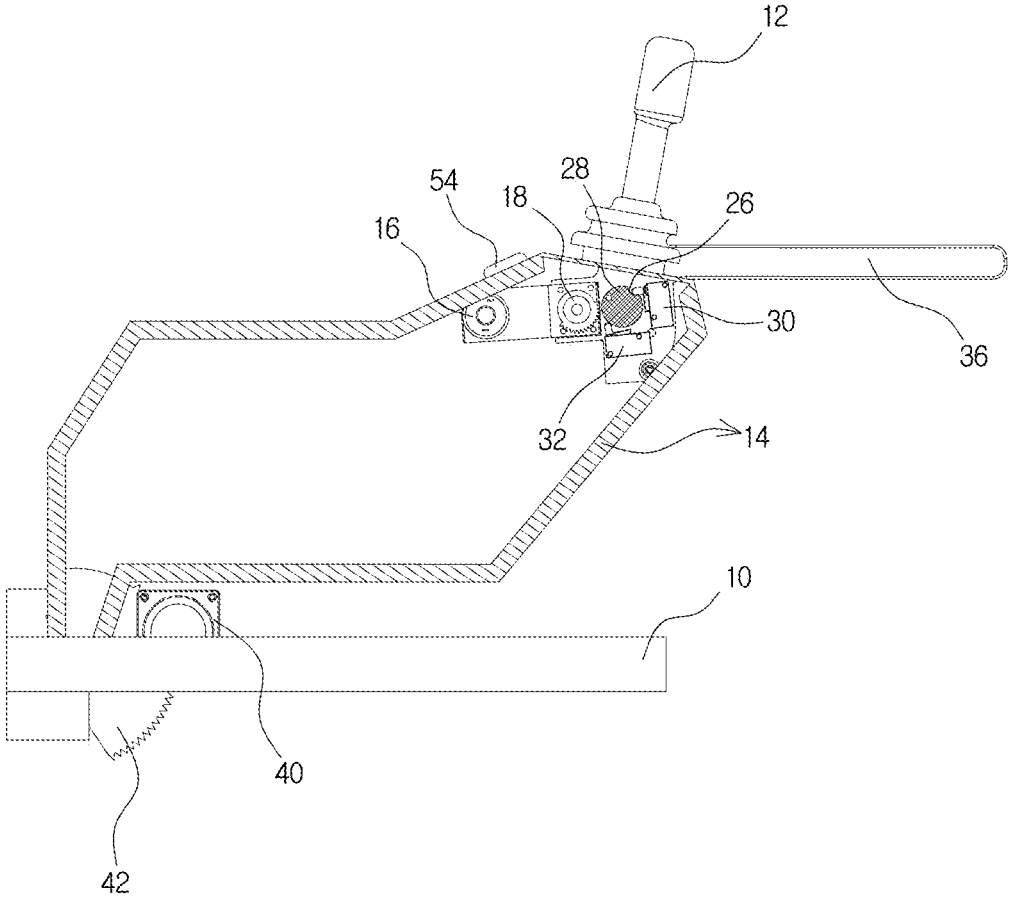
FIGS. 4 to 6 are cross-sectional views schematically illustrating some components of the console box for the excavator according to the first embodiment of the present invention.
Figure 5:
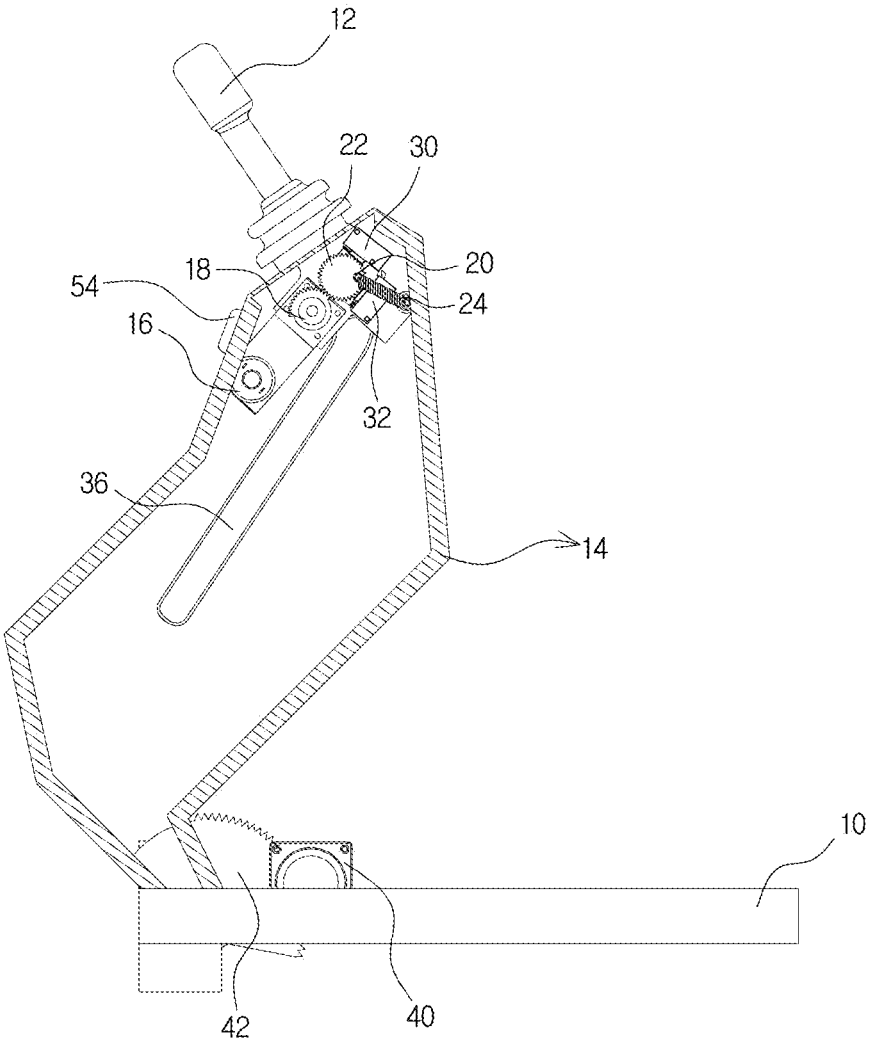
Figure 6:
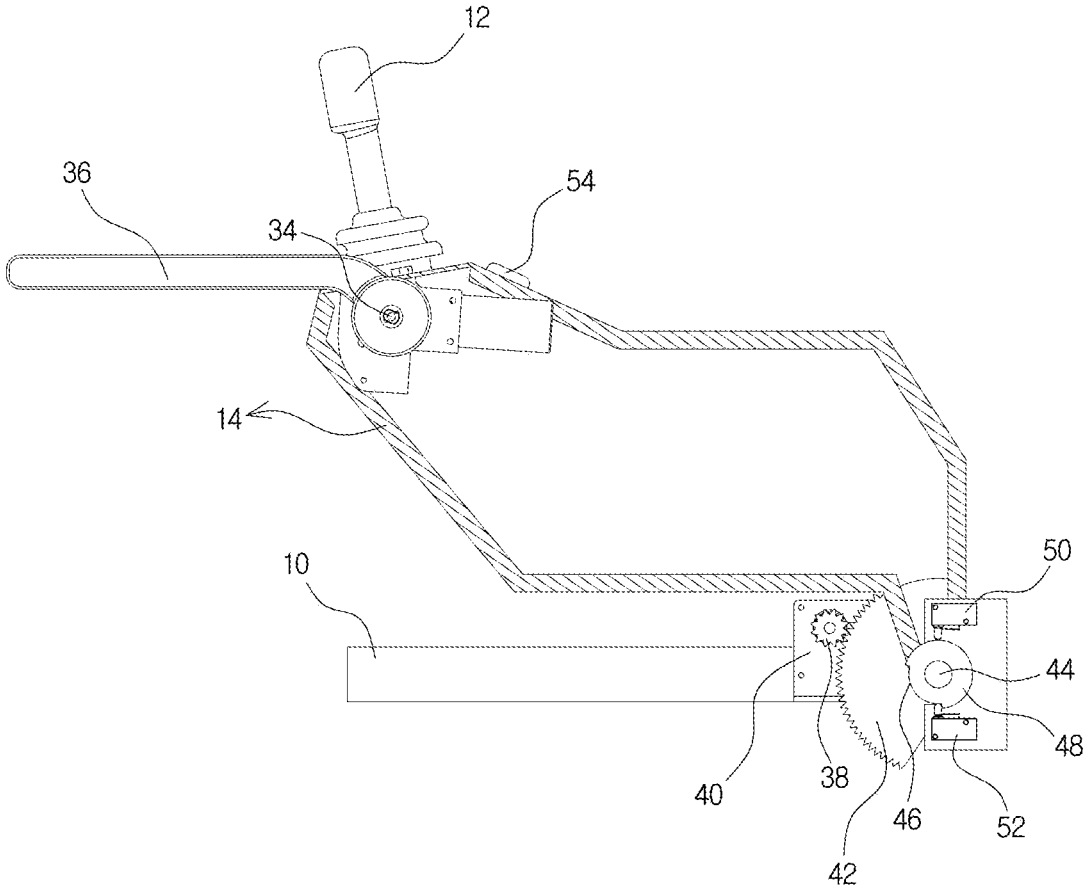

Preferred embodiments of the present invention will now be described in detail with reference to the accompanying drawings.

Referring to FIGS. 1 to 6, a console box for operating an excavator according to the first embodiment of the present invention includes: a plate-shaped stationary part 10 which is fixed to a cabin; a console housing 14 which is disposed on the stationary part 10 to be spaced apart from the stationary part 10, and has a receiving space therein, of which an operation lever 12 for manipulating the excavator is provided on an upper portion of the console housing, and a lower portion is rotatably connected to the stationary part 10 at a rear side of the lower portion; a safety lever motor 16 which is provided in the console housing 14 to supply a rotational force; a motor gear 18 which is connected to the safety lever motor 16 to receive the rotational force from the safety lever motor; a safety lever gear 22 which is connected to the motor gear 18 to receive the rotational force and is provided on one side with a lever spring fixture 20 extending to an outside; a lever spring 24 which is engaged to the lever spring fixture 20 of the safety lever gear 22 and the console housing 14 at both ends thereof to supply tension; a cylindrical safety lever cam 28 which is connected to the safety lever gear 22 by a shaft, of which an outer peripheral surface is provided with a cam groove 26; a pair of first and second sensors 30 and 32 which are installed on the outer peripheral surface of the safety lever cam 28 at a certain interval to detect the cam groove 26 of the safety lever cam 28; a cylindrical safety lever connecting shaft 34 which is rotatably connected to the safety lever cam 28 and extends in one direction; a safety lever 36 which is provided on one side of the console housing 14 in the shape of a cantilever to be held by a hand, and is connected to the safety lever connecting shaft 34 at one end thereof; a console motor 40 which is provided on the stationary part 10 to supply the rotational force and has a console motor gear 38; a fan-shaped console gear 42 which is installed to the rear lower portion of the console housing 14 and is provided on an outer peripheral surface thereof with gear teeth corresponding to the console motor gear 38, so that the rotational force of the console motor 40 is transferred to the console gear via the console motor gear 38 to rotate the console housing 14; a cylindrical console cam 48 which is provided on the rear lower portion of the console housing 14 and is connected to the console housing 14 by the cylindrical console shaft 44, of which an outer peripheral surface is provided with a console cam groove 46; first and second console sensors 50 and 52 which are respectively provided on upper and lower portions of the console cam 48 to detect the console cam groove 46 of the console cam 48; and a controller 54 which is provided on the console housing 14 to receive signals from the first and second sensors 30 and 32 and the first and second console sensors 50 and 52, as well as receiving an ON/OFF signal from a power of the excavator, to control the safety lever motor 16 and the console motor 40.

Specifically, the respective components of the console box for operating the excavator will now be described in more detail.

First of all, the stationary part 10 is fixed to the console box which is provided in the cabin to operate the excavator, and is formed in the shape of the plate.

In this instance, the stationary part 10 is engaged to the cabin to easily fix the console box which will be described later.

The console housing 14 is disposed on the stationary part 10 to be spaced apart from the stationary part 10, and has the receiving space therein. The console housing 14 includes the operation lever 12 provided on the upper portion to manipulate the excavator, and the lower portion of the console housing is rotatably connected to the stationary part 10 at the rear side of the lower portion.

In this instance, the operation lever 12 provided on the upper portion of the console case 14 is configured to operate the excavator, and is turned on or off by operation of the safety lever 36 which will be described later.

The rear side of the lower portion of the console housing 14 is rotatably engaged to the stationary part 10, and when an operator gets in or off the cabin, the console housing 14 is rotated to secure a space, so that the operate can easily get in or off the cabin.

The safety lever motor 16 is provided in the console housing 14 to supply the rotational force.

In this instance, the safety lever motor 16 supplies the safety lever with the rotational force. Specifically, the safety lever motor 16 is operated by the on/off signal of the power of the excavator or the control of the controller 54 to supply the rotational force.

The motor gear 18 is connected to the safety lever motor 16 to receive the rotational force from the safety lever motor.

In this instance, the motor gear 18 is preferably provided on the whole outer peripheral surface thereof with gear teeth. But, in order to manually operate the safety lever 36, as illustrated in FIG. 1, the gear teeth may be formed on the half of the outer peripheral surface of the motor gear 18.

When the motor gear 18 is rotated and then the safety lever gear 22 faces the smooth outer peripheral surface of the motor gear which is not provided with the gear teeth, the safety lever 36 can be operated by hand, and the position of the safety lever 36 can be fixed in a desired direction by the lever spring 24.

The safety lever gear 22 is connected to the motor gear 18 to receive the rotational force, and is provided on one side with the lever spring fixture 20 extending to the outside.

The lever spring 24 is engaged to the lever spring fixture 20 of the safety lever gear 22 and the console housing 14 at both ends thereof to supply tension.

In this instance, the safety lever gear 22 is rotated by the rotational force of the motor gear 18, and when the motor gear 18 is rotated and then the safety lever gear 22 faces the smooth outer peripheral surface of the motor gear which is not provided with the gear teeth, as described above, the lever spring 24 is to fix the manipulated position of the safety lever 36.

The cylindrical safety lever cam 28 is connected to the safety lever gear 22 by the shaft, and the outer peripheral surface of the safety lever cam is provided with the cam groove 26.

In this instance, since the safety lever cam 28 is provided with the cam groove 26, the rotation of the safety lever cam 28 is detected by the first sensor 30 and the second sensor 32.

The pair of first and second sensors 30 and 32 are installed on the outer peripheral surface of the safety lever cam 28 at a certain interval to detect the cam groove 26 of the safety lever cam 28.

In this instance, the first sensor 30 and the second sensor 32 includes a limit switch, and the position information of the safety lever 36 is transmitted to the controller 54 and an ECU of the excavator by the first sensor 30 and the second sensor 32 to operate the operation lever 12.

The cylindrical safety lever connecting shaft 34 is rotatably connected to the safety lever cam 28, and extends in one direction.

The safety lever 36 is provided on one side of the console housing 14 in the shape of the cantilever to be held by a hand, and one end of the safety lever is connected to the safety lever connecting shaft 34.

In this instance, the safety lever connecting shaft 34 and the safety lever 36 are rotated by the rotational force of the safety lever motor 16, but the operator can intentionally manipulate the safety lever 36 to allow the operation lever 12 to be on or off.

The console motor 40 is provided on the stationary part 10 to supply the rotational force, and has the console motor gear 38.

In this instance, the console housing 14 is rotated on the stationary part 10 by the console motor 40 to provide a space so that the operator can easily get in or off the cabin. The position of the console housing 14 is controlled by the rotational force supplied from the console motor 40 by manipulation of the controller 54 or the safety lever 36, which will be described later.

The fan-shaped console gear 42 is installed to the rear lower portion of the console housing 14, and is provided on the outer peripheral surface thereof with gear teeth corresponding to the console motor gear 38, so that the rotational force of the console motor 40 is transferred to the console gear 42 via the console motor gear 38 to rotate the console housing 14.

The cylindrical console cam 48 is provided on the rear lower portion of the console housing 14, and is connected to the console housing 14 by the cylindrical console shaft 44. The outer peripheral surface of the console cam 48 is provided with the console cam groove 46.

In this instance, since the console cam 48 is provided with the console cam groove 46, the first console sensor 50 and the second console sensor 52 can easily detect the rotation of the console cam 48, and a rotating angle of the console housing 14 can be easily adjusted.

The first and second console sensors 50 and 52 are respectively provided on upper and lower portions of the console cam 48 to detect the console cam groove 46 of the console cam 48.

In this instance, the signals of the first console sensor 50 and the second console sensor 52 are transmitted to the controller 54 and the ECU of the excavator.

The controller 54 is provided on the console housing 14 to receive the signals from the first and second sensors 30 and 32 and the first and second console sensors 50 and 52, as well as receiving the ON/OFF signal from the power of the excavator, to control the safety lever motor 16 and the console motor 40.

In this instance, the controller 54 is provided with a plurality of operation buttons, and the safety lever motor 16 and the console motor 40 are controlled by switching the operation buttons.

Figure 7:
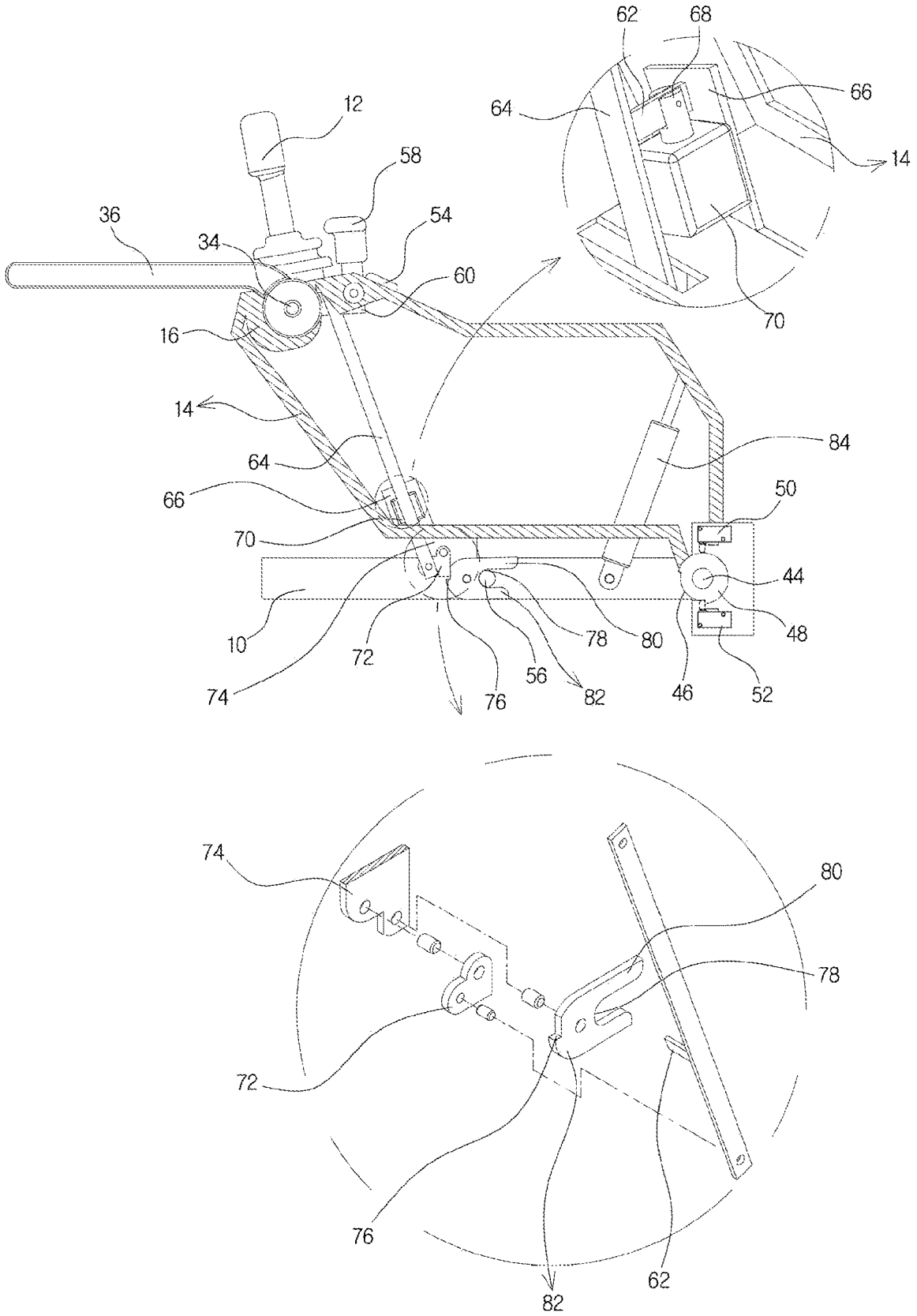
FIGS. 7 and 8 are cross-sectional views schematically illustrating the console box for the excavator according to the second embodiment of the present invention.
Figure 8:
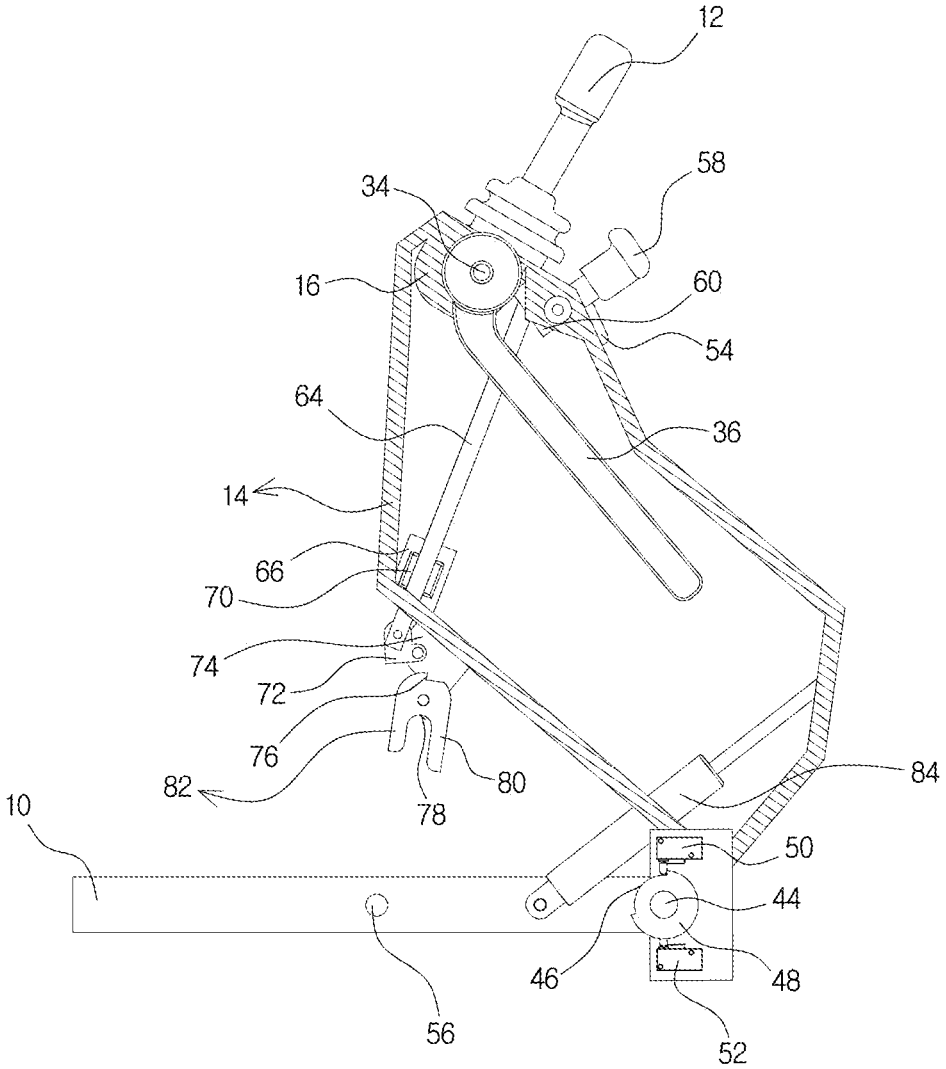

Referring to FIGS. 7 and 8, in the console box for the excavator according to the second embodiment of the present invention, a plate-shaped stationary part 10 is fixed to a console box which is provided in a cabin to operate the excavator. A cylindrical locking rod 56 protrudes from one side of the stationary part 10.

In this instance, locking rod 56 is locked to a locking piece 82 which will be described later, and the console housing 14 can be locked by engaging the locking rod 56 with the locking piece 82.

a console housing 14 is disposed on the stationary part 10 to be spaced apart from the stationary part 10, and has a receiving space therein. The console housing 14 includes an operation lever 12 provided on an upper portion to manipulate the excavator, and a lower portion of the console housing is rotatably connected to the stationary part 10 at a rear side of the lower portion.

The rear side of the lower portion of the console housing 14 is rotatably engaged to the stationary part 10, and when an operator gets in or off the cabin, the console housing 14 is rotated to secure a space, so that the operator can easily get in or off the cabin.

A safety lever motor 16 is provided in the console housing 14 to supply the rotational force. A motor gear 18 is connected to the safety lever motor 16 to receive the rotational force from the safety lever motor. A safety lever gear 22 is connected to the motor gear 18 to receive the rotational force, and is provided on one side with a lever spring fixture 20 extending to the outside. A lever spring 24 is engaged to the lever spring fixture 20 of the safety lever gear 22 and the console housing 14 at both ends thereof to supply tension. A cylindrical safety lever cam 28 is connected to the safety lever gear 22 by a shaft, and an outer peripheral surface of the safety lever cam is provided with a cam groove 26. A pair of first and second sensors 30 and 32 are installed on an outer peripheral surface of the safety lever cam 28 at a certain interval to detect the cam groove 26 of the safety lever cam 28. A cylindrical safety lever connecting shaft 34 is rotatably connected to the safety lever cam 28, and extends in one direction. A safety lever 36 is provided on one side of the console housing 14 in the shape of the cantilever to be held by a hand, and one end of the safety lever is connected to the safety lever connecting shaft 34.

The configurations of the safety lever motor 16, the motor gear 18, the lever spring fixture 20, the safety lever gear 22, the lever spring 24, the cam groove 26, the safety lever cam 28, the first sensor 30, the second sensor 32, the safety lever connecting shaft 34, and the safety lever 36 are substantially identical to those illustrated in FIGS. 1 to 6, and thus the detailed description will be omitted herein.

A console lever 58 protrudes from the operation lever 12 of the console housing 14 in a rearward direction to be held by a hand. A lower portion of the console lever 58 extends and penetrates the upper portion of the console housing 14, and is engaged to the console housing by a shaft.

In this instance, the console lever 58 is held and operated by the operator so that the console housing 14 is rotated by a console cylinder 84 which will be described later with reference to FIG. 8.

A console lever bar 60 extends forwardly from the extended lower portion of the console lever 58.

A connecting shaft 64 is engaged to a front portion of the console lever bar 60 by a hinge, and extends downwardly to penetrate the lower portion of the console housing 14. The connecting shaft 64 is provided with a connecting bar 62 protruding outwardly within the console housing 14.

In this instance, the console lever bar 60 and the connecting shaft 64 are cooperatively operated by the console lever 58 which is manipulate by the operator.

A plate-shaped solenoid support 66 is provided on an inner lower portion of the console housing 14, and extends upwardly.

A solenoid 70 is engaged to the solenoid support 66, and is provided on an upper portion thereof with a solenoid bar 68 which is slidably moved in a vertical direction and is engaged to the connecting bar 62 at an upper portion.

In this instance, the solenoid 70 is controlled by a controller 54 which will be described later, to prevent operation of the connecting shaft 64.

A plate-shaped fixing plate 72 is provided below a lower portion of the connecting bar 62, and a front lower portion of the fixing plate 72 is engaged to the lower portion of the connecting bar 62 by a hinge.

A plate-shaped bracket 74 is engaged to the lower portion of the console housing 14 at a lower portion thereof, and an inner front portion of the bracket 74 is engaged to a rear upper portion of the fixing plate 72.

In this instance, the bracket 74 is configured to allow the fixing plate 72 to rotate, as well as allowing the locking piece 82 to rotate, as illustrated in FIGS. 7 and 8.

The locking piece 82 is formed in the shape of a plate, and is provided on the rear portion of the fixing plate 72. A front portion of the locking plate 82 is provided with a locking groove 76 to which the rear portion of the fixing plate 72 is locked, and a pair of extensions 80 extends rearwardly from a rear portion of the locking piece 82 in a vertically spaced state. A receiving groove 78 is formed between the pair of extensions 80 to receive the locking rod 56. The inner side of the locking piece 82 is engaged to the rear lower portion of the bracket 74 by a hinge.

In this instance, the receiving groove 78 of the locking piece 82 receives the locking rod 56 to prevent rotation of the console housing 14. If the fixing plate 72 locked to the locking groove 76 is synchronized with movement of the connecting shaft 64, the fixing plate 72 is released from the locking groove 76 of the locking piece 82, thereby allowing the console housing 14 to rotate.

The console cylinder 84 has a lower portion engaged to the rear portion of the stationary part 10, and an upper portion penetrating the console housing 14 and engaged to the inner upper portion of the console housing 14.

The console cylinder 84 allows the console housing 14 to rotate in an upward direction, and prevents the console housing 14 from being quickly rotated when the console housing 14 is rotated in a downward direction.

A cylindrical console cam 48 is provided on the rear lower portion of the console housing 14, and is connected to the console housing 14 by a cylindrical console shaft 44. An outer peripheral surface of the console cam 48 is provided with a console cam groove 46.

A pair of first and second console sensors 50 and 52 are respectively provided on upper and lower portions of the console cam 48 to detect the console cam groove 46 of the console cam 48.

Since the console cam 48 is provided with the console cam groove 46, the first console sensor 50 and the second console sensor 52 can easily detect the rotation of the console cam 48, and adjust a rotating angle of the console housing 14.

Also, the signals of the first console sensor 50 and the second console sensor 52 are transmitted to the controller 54 and the ECU of the excavator.

A controller 54 is provided on the console housing 14 to receive the signals from the first and second sensors 30 and 32, the solenoid 70, and the first and second console sensors 50 and 52, as well as receiving the ON/OFF signal from the power of the excavator, to control the safety lever motor 16 and the console cylinder 84.

In this instance, the controller 54 is provided with a plurality of operation buttons, and the safety lever motor 16 and the solenoid 70 are controlled by switching the operation buttons.

Figure 9:
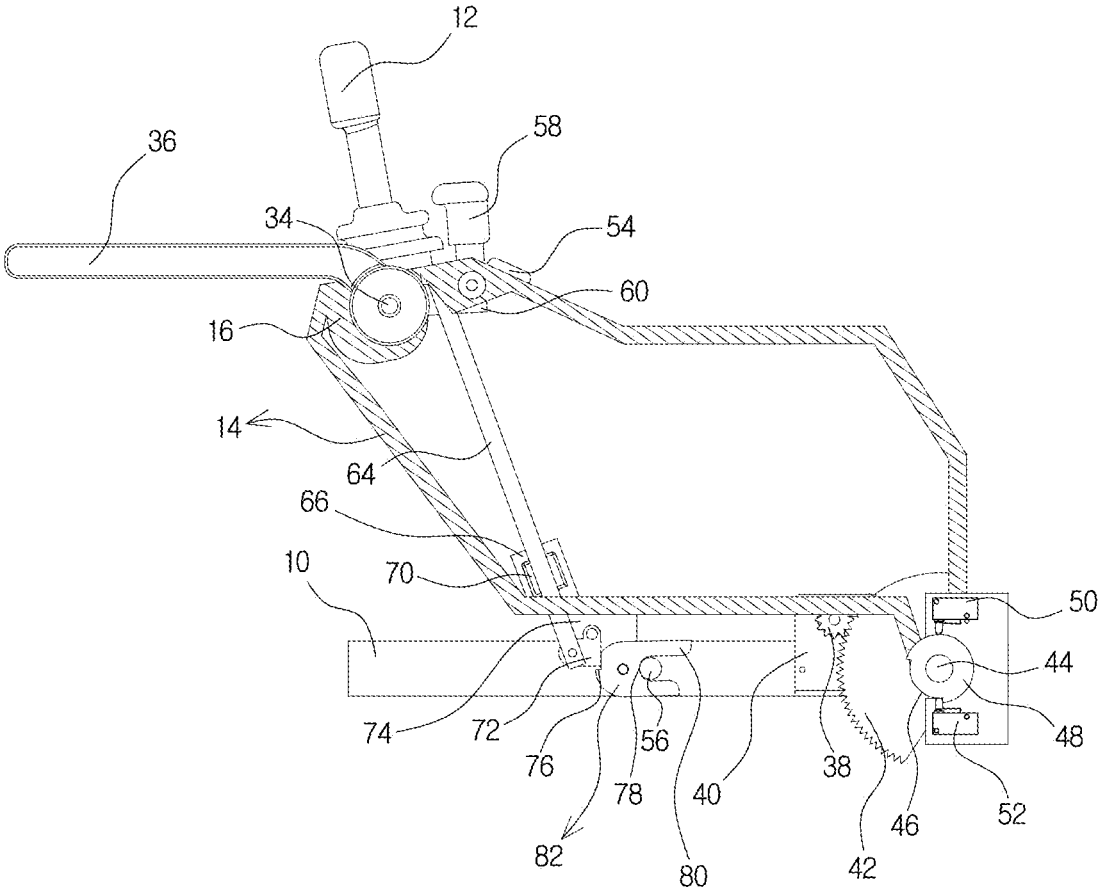
FIG. 9 is a cross-sectional view schematically illustrating the console box for the excavator according to the third embodiment of the present invention.

Referring to FIG. 9, a console box for operating an excavator according to the third embodiment of the present invention includes: a plate-shaped stationary part 10 which is fixed to a cabin, with a cylindrical locking rod 56 protruding from one side of the stationary part 10; a console housing 14 which is disposed on the stationary part 10 to be spaced apart from the stationary part 10, and has a receiving space therein, of which an operation lever 12 for manipulating the excavator is provided on an upper portion of the console housing, and a lower portion is rotatably connected to the stationary part 10 at a rear side of the lower portion; a safety lever motor 16 which is provided in the console housing 14 to supply a rotational force; a motor gear 18 which is connected to the safety lever motor 16 to receive the rotational force from the safety lever motor; a safety lever gear 22 which is connected to the motor gear 18 to receive the rotational force and is provided on one side with a lever spring fixture 20 extending to an outside; a lever spring 24 which is engaged to the lever spring fixture 20 of the safety lever gear 22 and the console housing 14 at both ends thereof to supply tension; a cylindrical safety lever cam 28 which is connected to the safety lever gear 22 by a shaft, of which an outer peripheral surface is provided with a cam groove 26; a pair of first and second sensors 30 and 32 which are installed on the outer peripheral surface of the safety lever cam 28 at a certain interval to detect the cam groove 26 of the safety lever cam 28; a cylindrical safety lever connecting shaft 34 which is rotatably connected to the safety lever cam 28 and extending in one direction; a safety lever 36 which is provided on one side of the console housing 14 in the shape of a cantilever to be held by a hand, and is connected to the safety lever connecting shaft 34 at one end thereof; a console lever 58 which protrudes from the operation lever 12 of the console housing 14 in a rearward direction to be held by a hand, of which a lower portion of the console lever 58 extends and penetrates the upper portion of the console housing 14, and is engaged to the console housing by a shaft; a console lever bar 60 which extends forwardly from the extended lower portion of the console lever 58; a connecting shaft 64 which is engaged to a front portion of the console lever bar 60 by a hinge, and extends downwardly to penetrate the lower portion of the console housing 14, with the connecting shaft 64 being provided with a connecting bar 62 protruding outwardly within the console housing 14; a plate-shaped solenoid support 66 which is provided on an inner lower portion of the console housing 14, and extends upwardly; a solenoid 70 which is engaged to the solenoid support 66, and is provided on an upper portion thereof with a solenoid bar 68 which is slidably moved in a vertical direction and is engaged to the connecting bar 62 at an upper portion; a plate-shaped fixing plate 72 which is provided below a lower portion of the connecting bar 62, of which a front lower portion is engaged to the lower portion of the connecting bar 62 by a hinge; a plate-shaped bracket 74 which is engaged to the lower portion of the console housing 14 at a lower portion thereof, of which an inner front portion is engaged to a rear upper portion of the fixing plate 72; a plate-shaped locking piece 82 which is provided on the rear portion of the fixing plate 72, of which a front portion is provided with a locking groove 76 to which the rear portion of the fixing plate 72 is locked, and a pair of extensions 80 extends rearwardly from a rear portion of locking piece 82 in a vertically spaced state, in which a receiving groove 78 is formed between the pair of extensions 80 to receive the locking rod 56, and an inner side of the locking piece 82 is engaged to the rear lower portion of the bracket 74 by a hinge; a console motor 40 which is provided on the stationary part 10 to supply the rotational force and has a console motor gear 38; a fan-shaped console gear 42 which is installed on the rear lower portion of the console housing 14 and is provided on an outer peripheral surface thereof with gear teeth corresponding to the console motor gear 38, so that the rotational force of the console motor 40 is transferred to the console gear via the console motor gear 38 to rotate the console housing 14; a cylindrical console cam 48 which is provided on the rear lower portion of the console housing 14 and is connected to the console housing 14 by the cylindrical console shaft 44, of which an outer peripheral surface is provided with a console cam groove 46; first and second console sensors 50 and 52 which are respectively provided on upper and lower portions of the console cam 48 to detect the console cam groove 46 of the console cam 48; and a controller 54 which is provided on the console housing 14 to receive signals from the first and second sensors 30 and 32, the solenoid 70, and the first and second console sensors 50 and 52, as well as receiving an ON/OFF signal from a power of the excavator, to control the safety lever motor 16 and the console motor 40.

The configuration of the above console box is substantially identical to that in the second embodiment, and thus the detailed description thereof will be omitted herein.

Figure 10:
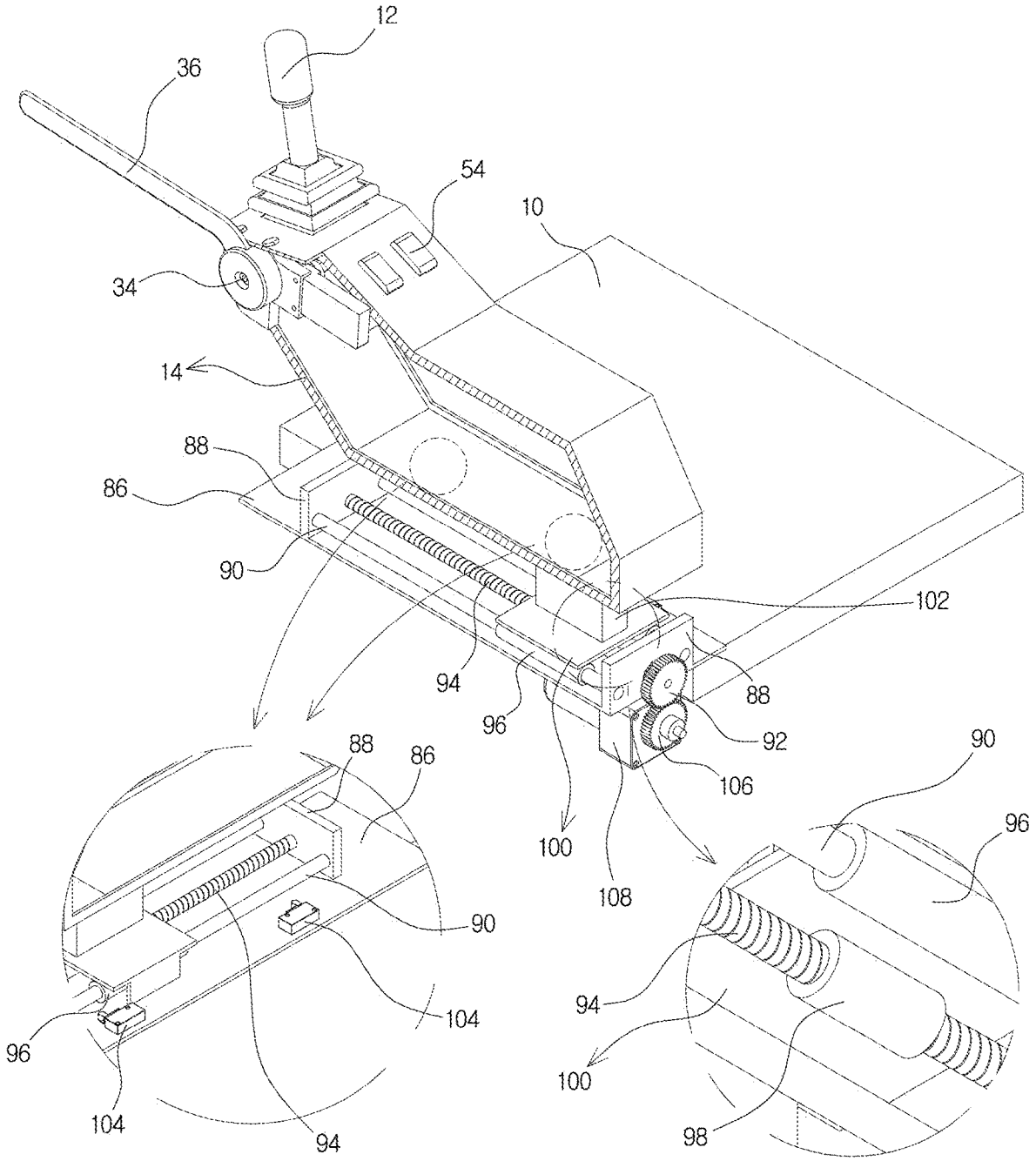
FIG. 10 is a perspective view schematically illustrating the console box for the excavator according to the fourth embodiment of the present invention.

Referring to FIG. 10, a console box for operating an excavator according to the fourth embodiment of the present invention includes: a plate-shaped stationary part 10 which is fixed to a cabin; a console housing 14 which is disposed on the stationary part 10 to be spaced apart from the stationary part 10, and has a receiving space therein, of which an operation lever 12 for manipulating the excavator is provided on an upper portion of the console housing; a safety lever motor 16 which is provided in the console housing 14 to supply a rotational force; a motor gear 18 which is connected to the safety lever motor 16 to receive the rotational force from the safety lever motor; a safety lever gear 22 which is connected to the motor gear 18 to receive the rotational force and is provided on one side with a lever spring fixture 20 extending to an outside; a lever spring 24 which is engaged to the lever spring fixture 20 of the safety lever gear 22 and the console housing 14 at both ends thereof to supply tension; a cylindrical safety lever cam 28 which is connected to the safety lever gear 22 by a shaft, of which an outer peripheral surface is provided with a cam groove 26; a pair of first and second sensors 30 and 32 which are installed on the outer peripheral surface of the safety lever cam 28 at a certain interval to detect the cam groove 26 of the safety lever cam 28; a cylindrical safety lever connecting shaft 34 which is rotatably connected to the safety lever cam 28 and extends in one direction; a safety lever 36 which is provided on one side of the console housing 14 in the shape of a cantilever to be held by a hand, and is connected to the safety lever connecting shaft 34 at one end thereof; a plate-shaped sliding stop plate 86 which is provided away from the lower portion of the console housing 14, with an extending side being fixed to the stationary part 10; a pair of extension plates 88 which are spaced away from each other in a longitudinal direction on an upper portion of the sliding stop plate 86 and extend in an upward direction; a pair of cylindrical sliding guide rods 90 which are spaced apart from each other, with front and rear portions being respectively fixed to the extension plates 88; a threaded rod 94 which is rotatably disposed between the sliding guide rods 90 and is provided on an outer peripheral surface thereof with a threaded portion, of which a rear end penetrates the extension plate 88 and extends in a rearward direction, and a gear 92 is engaged to the extended end of the threaded rod; a plate-shaped slidable plate 100 which is provided on the threaded rods 94 and has on a bottom surface thereof a pair of sliding rods 96 to slidably move along the sliding guide rods, respectively, and a threaded sleeve 98 fastened with the threaded rod 94 to be moved in a longitudinal direction by rotation of the threaded rod between the pair of sliding rods 96; a console fixture 102 which is engaged to an upper portion of the slidable plate 100 at a lower portion, with an upper portion of the console fixture being extending and engaged to the lower portion of the console housing 14; a pair of sliding sensors 104 which are spaced apart from each other in the longitudinal direction on the sliding stop plate 86 to detect movement of the slidable plate 100; a screw motor 108 which is provided below the sliding stop plate 86 to supply a rotational force, and has a gear 92 engaged to a rear end and formed in the shape corresponding to gear 92 of the threaded rod 94 to transfer the rotational force to the gear 92; and a controller 54 which is provided on the console housing 14 and receives signals from the first and second sensors 30 and 32 and the sliding sensors 104, as well as receiving an ON/OFF signal from a power of the excavator, to control the safety lever motor 16 and the screw motor 108.

In this instance, the console housing 14 is moved back and forth by the rotation of the screw motor 108.

Figure 11:
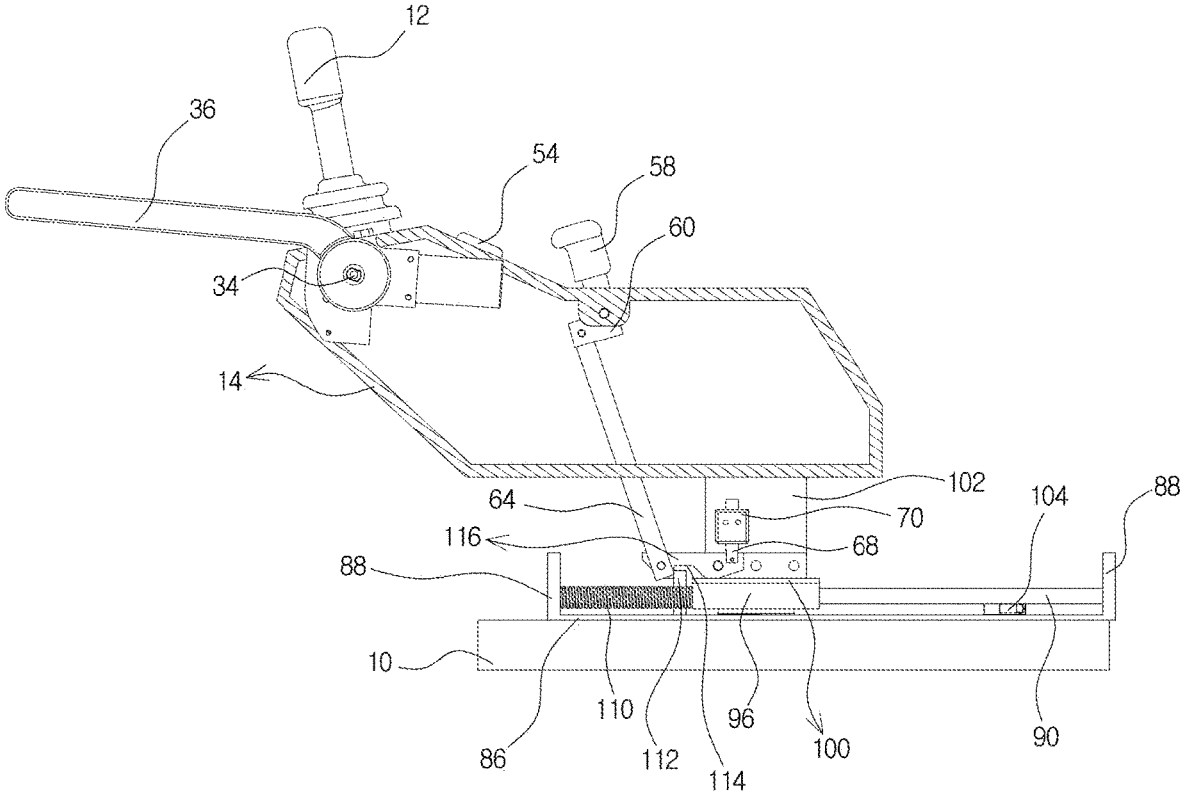
FIGS. 11 and 12 are cross-sectional views schematically illustrating the console box for the excavator according to the fifth embodiment of the present invention.
Figure 12:
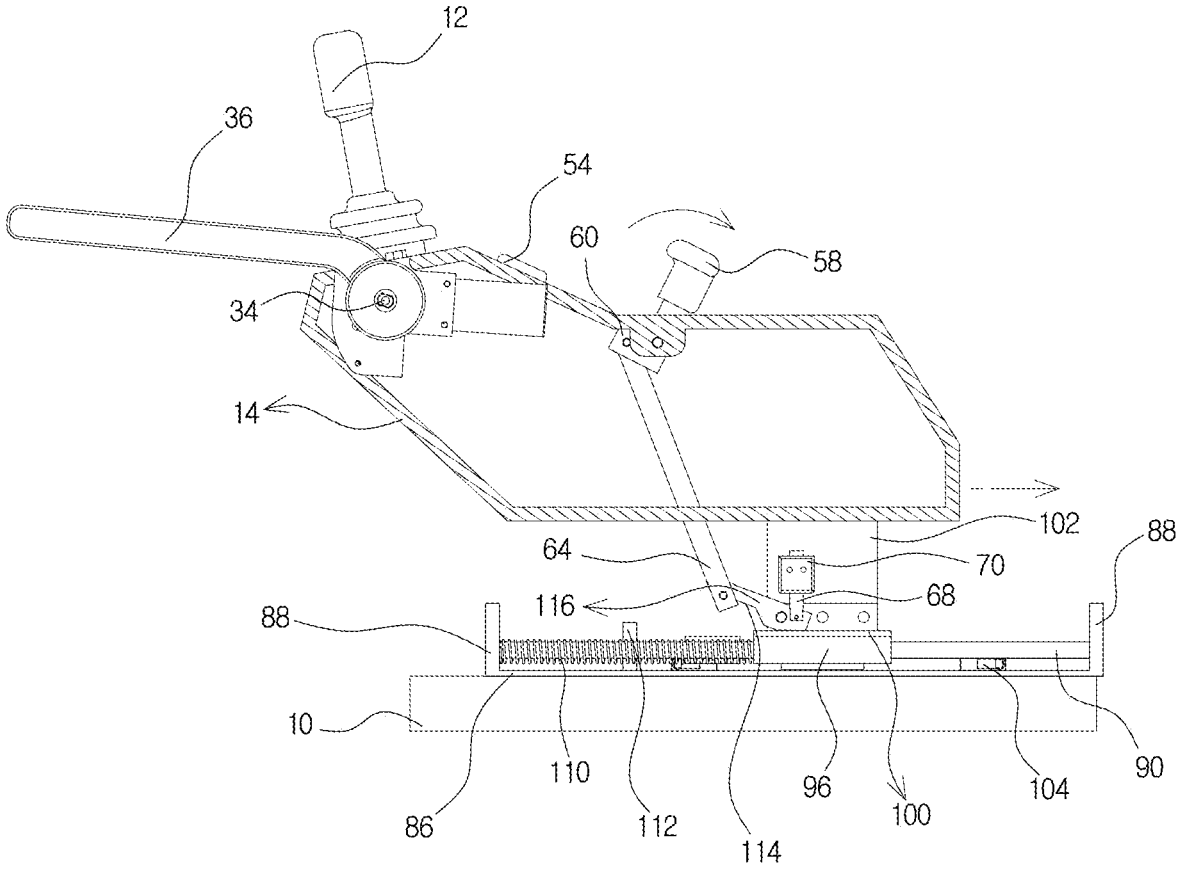

Referring to FIGS. 11 and 12, a console box for operating an excavator according to the fifth embodiment of the present invention includes: a plate-shaped stationary part 10 which is fixed to a cabin; a console housing 14 which is disposed on the stationary part 10 to be spaced apart from the stationary part 10, and has a receiving space therein, of which an operation lever 12 for manipulating the excavator is provided on an upper portion of the console housing; a safety lever motor 16 which is provided in the console housing 14 to supply a rotational force; a motor gear 18 which is connected to the safety lever motor 16 to receive the rotational force from the safety lever motor; a safety lever gear 22 which is connected to the motor gear 18 to receive the rotational force and is provided on one side with a lever spring fixture 20 extending to an outside; a lever spring 24 which is engaged to the lever spring fixture 20 of the safety lever gear 22 and the console housing 14 at both ends thereof to supply tension; a cylindrical safety lever cam 28 which is connected to the safety lever gear 22 by a shaft, of which an outer peripheral surface is provided with a cam groove 26; a pair of first and second sensors 30 and 32 which are installed on the outer peripheral surface of the safety lever cam 28 at a certain interval to detect the cam groove 26 of the safety lever cam 28; a cylindrical safety lever connecting shaft 34 which is rotatably connected to the safety lever cam 28 and extending in one direction; a safety lever 36 which is provided on one side of the console housing 14 in the shape of a cantilever to be held by a hand, and is connected to the safety lever connecting shaft 34 at one end thereof; a console lever 58 which protrudes from the operation lever 12 of the console housing 14 in a rearward direction to be held by a hand, of which a lower portion of the console lever 58 extends and penetrates the upper portion of the console housing 14, and is engaged to the console housing by a shaft; a console lever bar 60 which extends forwardly from the extended lower portion of the console lever 58; a connecting shaft 64 which is engaged to a front portion of the console lever bar 60 by a hinge, and extends downwardly to penetrate the lower portion of the console housing 14, with the connecting shaft 64 being provided with a connecting bar 62 protruding outwardly within the console housing 14; a plate-shaped sliding stop plate 86 which is provided away from the lower portion of the console housing 14, with an extending side being fixed to the stationary part 10; a pair of extension plates 88 which are spaced away from each other in a longitudinal direction on an upper portion of the sliding stop plate 86 and extend in an upward direction; a pair of cylindrical sliding guide rods 90 which are spaced apart from each other, with front and rear portions being respectively fixed to the extension plates 88; a pair of sliding springs 110 which are provided on an outer peripheral surface of each sliding guide rod 90 to provide tension; a plate-shaped latchet plate 112 extending upwardly from an upper portion of the sliding stop plate 86 between the sliding guide rods 90; a plate-shaped slidable plate 100 which is provided on the sliding guide rods 90, and has a pair of sliding rods 96 which are positioned in front of the sliding spring 110 and are slidably moved on the sliding guide rods 90; a console fixture 102 which is engaged to an upper portion of the slidable plate 100 at a lower portion, with an upper portion of the console fixture being extending and engaged to the lower portion of the console housing 14; a solenoid 70 which is engaged to the solenoid support 66, and is provided on an upper portion thereof with a solenoid bar 68 which is slidably moved in a vertical direction; a plate-shaped movement stopper 116 which is provided on the console fixture 102, of which a rear portion is engaged to the solenoid bar 68 by a hinge, an inner side is engaged to the console fixture 102 by a shaft, and a front lower portion has a movement stopping groove 114 to be locked by the latchet plate 112; a pair of sliding sensors 104 which are spaced apart from each other in the longitudinal direction on the sliding stop plate 86 to detect movement of the slidable plate 100; and a controller 54 which is provided on the console housing 14 and receives signals from the first and second sensors 30 and 32 and the sliding sensors 104, as well as receiving an ON/OFF signal from a power of the excavator, to control the safety lever motor 16 and the solenoid 70.

In this instance, the console housing 14 is moved in a rearward direction by the sliding spring 110. The console housing 14 is moved in a forward direction by an operator, but the console housing 14 can be moved in the forward direction by a cylinder.

With the console box for the excavator according to the present invention, the safety lever 36 for operating the operation lever 12 which operates the excavator can be automatically operated or released under the control of the controller 54, or according to the on/off signal of the power for the excavator, thereby preventing malfunction of the operation lever 12. In addition, the console housing 14 is automatically rotated at a desired angle, or is automatically moved to a desired position, under the control of the controller 54, or according to the on/off signal of the power for the excavator, so that the operator can easily get in or off the excavator.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A console box for operating an excavator comprising:

a plate-shaped stationary part (10) which is fixed to a cabin;

a console housing (14) which is disposed on the stationary part (10) to be spaced apart from the stationary part (10), and has a receiving space therein, of which an operation lever (12) for manipulating the excavator is provided on an upper portion of the console housing, and a lower portion is rotatably connected to the stationary part (10) at a rear side of the lower portion;

a safety lever motor (16) which is provided in the console housing (14) to supply a rotational force;

a motor gear (18) which is connected to the safety lever motor (16) to receive the rotational force from the safety lever motor;

a safety lever gear (22) which is connected to the motor gear (18) to receive the rotational force and is provided on one side with a lever spring fixture (20) extending to an outside;

a lever spring (24) which is engaged to the lever spring fixture (20) of the safety lever gear (22) and the console housing (14) at both ends thereof to supply tension;

a cylindrical safety lever cam (28) which is connected to the safety lever gear (22) by a shaft, of which an outer peripheral surface is provided with a cam groove (26);

a pair of first and second sensors (30 and 32) which are installed on the outer peripheral surface of the safety lever cam (28) at a certain interval to detect the cam groove (26) of the safety lever cam (28);

a cylindrical safety lever connecting shaft (34) which is rotatably connected to the safety lever cam (28) and extends in one direction;

a safety lever (36) which is provided on one side of the console housing (14) in the shape of a cantilever to be held by a hand, and is connected to the safety lever connecting shaft (34) at one end thereof;

a console motor (40) which is provided on the stationary part (10) to supply a rotational force and has a console motor gear (38);

a fan-shaped console gear (42) which is installed to the rear lower portion of the console housing (14) and is provided on an outer peripheral surface thereof with gear teeth corresponding to the console motor gear (38), so that the rotational force of the console motor (40) is transferred to the console gear via the console motor gear (38) to rotate the console housing (14);

a cylindrical console cam (48) which is provided on the rear lower portion of the console housing (14) and is connected to the console housing (14) by the cylindrical console shaft (44), of which an outer peripheral surface is provided with a console cam groove (46);

first and second console sensors (50 and 52) which are respectively provided on upper and lower portions of the console cam (48) to detect the console cam groove (46) of the console cam (48); and a controller (54) which is provided on the console housing (14) to receive signals from the first and second sensors (30 and 32) and the first and second console sensors (50 and 52), as well as receiving an ON/OFF signal from a power of the excavator, to control the safety lever motor (16) and the console motor (40).

2. A console box for an excavator comprising:

a plate-shaped stationary part (10) which is fixed to a console box which is provided in a cabin to operate the excavator, with a cylindrical locking rod (56) protruding from one side of the stationary part (10);

a console housing (14) which is disposed on the stationary part (10) to be spaced apart from the stationary part (10), and having a receiving space therein, the console housing (14) including an operation lever (12) provided on an upper portion to manipulate the excavator, and a lower portion of the console housing being rotatably connected to the stationary part (10) at a rear side of the lower portion;

a safety lever motor (16) which is provided in the console housing (14) to supply a rotational force;

a motor gear (18) which is connected to the safety lever motor (16) to receive the rotational force from the safety lever motor;

a safety lever gear (22) which is connected to the motor gear (18) to receive the rotational force, and is provided on one side with a lever spring fixture (20) extending to the outside;

a lever spring (24) which is engaged to the lever spring fixture (20) of the safety lever gear (22) and the console housing (14) at both ends thereof to supply tension;

a cylindrical safety lever cam (28) which is connected to the safety lever gear (22) by a shaft, with an outer peripheral surface of the safety lever cam being provided with a cam groove (26);

a pair of first and second sensors (30 and 32) which are installed on an outer peripheral surface of the safety lever cam (28) at a certain interval to detect the cam groove (26) of the safety lever cam (28);

a cylindrical safety lever connecting shaft (34) which is rotatably connected to the safety lever cam (28), and extends in one direction;

a safety lever (36) which is provided on one side of the console housing (14) in the shape of a cantilever to be held by a hand, with one end of the safety lever being connected to the safety lever connecting shaft (34);

a console lever (58) which protrudes from the operation lever (12) of the console housing (14) in a rearward direction to be held by a hand, with a lower portion of the console lever (58) extending and penetrating the upper portion of the console housing (14), and being engaged to the console housing by a shaft;

a console lever bar (60) which extends forwardly from the extended lower portion of the console lever (58);

a connecting shaft (64) which is engaged to a front portion of the console lever bar (60) by a hinge, and extends downwardly to penetrate the lower portion of the console housing (14), with the connecting shaft (64) being provided with a connecting bar (62) protruding outwardly within the console housing (14);

a plate-shaped solenoid support (66) which is provided on an inner lower portion of the console housing (14), and extends upwardly;

a solenoid (70) which is engaged to the solenoid support (66), and is provided on an upper portion thereof with a solenoid bar (68) which is slidably moved in a vertical direction and is engaged to the connecting bar (62) at an upper portion;

a plate-shaped fixing plate (72) which is provided below a lower portion of the connecting bar (62), with a front lower portion of the fixing plate (72) being engaged to the lower portion of the connecting bar (62) by a hinge;

a plate-shaped bracket (74) which is engaged to the lower portion of the console housing (14) at a lower portion thereof, with an inner front portion of the bracket (74) being engaged to a rear upper portion of the fixing plate (72);

a plate-shaped locking piece (82) which is provided on the rear portion of the fixing plate (72), with a front portion of the locking plate (82) being provided with a locking groove (76) to which the rear portion of the fixing plate (72) is locked, and a pair of extensions (80) extending rearwardly from a rear portion of locking piece (82) in a vertically spaced state, in which a receiving groove (78) is formed between the pair of extensions (80) to receive the locking rod (56), and the inner side of the locking piece (82) is engaged to the rear lower portion of the bracket (74) by a hinge;

a console cylinder (84) which has a lower portion engaged to the rear portion of the stationary part (10), with an upper portion penetrating the console housing (14) and being engaged to the inner upper portion of the console housing (14);

a cylindrical console cam (48) which is provided on the rear lower portion of the console housing (14), and is connected to the console housing (14) by a cylindrical console shaft (44), with an outer peripheral surface of the console cam (48) being provided with a console cam groove (46);

a pair of first and second console sensors (50 and 52) which are respectively provided on upper and lower portions of the console cam (48) to detect the console cam groove (46) of the console cam (48); and a controller (54) which is provided on the console housing (14) to receive the signals from the first and second sensors (30 and 32), the solenoid (70), and the first and second console sensors (50 and 52), as well as receiving an ON/OFF signal from a power of the excavator, to control the safety lever motor (16) and the console cylinder (84).

3. A console box for operating an excavator comprising:

a plate-shaped stationary part (10) which is fixed to a cabin, with a cylindrical locking rod (56) protruding from one side of the stationary part (10);

a console housing (14) which is disposed on the stationary part (10) to be spaced apart from the stationary part (10), and has a receiving space therein, of which an operation lever (12) for manipulating the excavator is provided on an upper portion of the console housing, and a lower portion is rotatably connected to the stationary part (10) at a rear side of the lower portion;

a safety lever motor (16) which is provided in the console housing (14) to supply a rotational force;

a motor gear (18) which is connected to the safety lever motor (16) to receive the rotational force from the safety lever motor;

a safety lever gear (22) which is connected to the motor gear (18) to receive the rotational force and is provided on one side with a lever spring fixture (20) extending to an outside;

a lever spring (24) which is engaged to the lever spring fixture (20) of the safety lever gear (22) and the console housing (14) at both ends thereof to supply tension;

a cylindrical safety lever cam (28) which is connected to the safety lever gear (22) by a shaft, of which an outer peripheral surface is provided with a cam groove (26);

a pair of first and second sensors (30 and 32) which are installed on the outer peripheral surface of the safety lever cam (28) at a certain interval to detect the cam groove (26) of the safety lever cam (28);

a cylindrical safety lever connecting shaft (34) which is rotatably connected to the safety lever cam (28) and extending in one direction;

a safety lever (36) which is provided on one side of the console housing (14) in the shape of a cantilever to be held by a hand, and is connected to the safety lever connecting shaft (34) at one end thereof;

a console lever (58) which protrudes from the operation lever (12) of the console housing (14) in a rearward direction to be held by a hand, of which a lower portion of the console lever (58) extends and penetrates the upper portion of the console housing (14), and is engaged to the console housing by a shaft;

a console lever bar (60) which extends forwardly from the extended lower portion of the console lever (58);

a connecting shaft (64) which is engaged to a front portion of the console lever bar (60) by a hinge, and extends downwardly to penetrate the lower portion of the console housing (14), with the connecting shaft (64) being provided with a connecting bar (62) protruding outwardly within the console housing (14);

a plate-shaped solenoid support (66) which is provided on an inner lower portion of the console housing (14), and extends upwardly;

a solenoid (70) which is engaged to the solenoid support (66), and is provided on an upper portion thereof with a solenoid bar (68) which is slidably moved in a vertical direction and is engaged to the connecting bar (62) at an upper portion;

a plate-shaped fixing plate (72) which is provided below a lower portion of the connecting bar (62), of which a front lower portion is engaged to the lower portion of the connecting bar (62) by a hinge;

a plate-shaped bracket (74) which is engaged to the lower portion of the console housing (14) at a lower portion thereof, of which an inner front portion is engaged to a rear upper portion of the fixing plate (72);

a plate-shaped locking piece (82) which is provided on the rear portion of the fixing plate (72), of which a front portion is provided with a locking groove (76) to which the rear portion of the fixing plate (72) is locked, and a pair of extensions (80) extends rearwardly from a rear portion of locking piece (82) in a vertically spaced state, in which a receiving groove (78) is formed between the pair of extensions (80) to receive the locking rod (56), and an inner side of the locking piece (82) is engaged to the rear lower portion of the bracket (74) by a hinge;

a console motor (40) which is provided on the stationary part (10) to supply the rotational force and has a console motor gear (38);

a fan-shaped console gear (42) which is installed on the rear lower portion of the console housing (14) and is provided on an outer peripheral surface thereof with gear teeth corresponding to the console motor gear (38), so that the rotational force of the console motor (40) is transferred to the console gear via the console motor gear (38) to rotate the console housing (14);

a cylindrical console cam (48) which is provided on the rear lower portion of the console housing (14) and is connected to the console housing (14) by the cylindrical console shaft (44), of which an outer peripheral surface is provided with a console cam groove (46);

first and second console sensors (50 and 52) which are respectively provided on upper and lower portions of the console cam (48) to detect the console cam groove (46) of the console cam (48); and a controller (54) which is provided on the console housing (14) to receive signals from the first and second sensors (30 and 32), the solenoid (70), and the first and second console sensors (50 and 52), as well as receiving an ON/OFF signal from a power of the excavator, to control the safety lever motor (16) and the console motor (40).

4. A console box for operating an excavator comprising:

a plate-shaped stationary part (10) which is fixed to a cabin;

a console housing (14) which is disposed on the stationary part (10) to be spaced apart from the stationary part (10), and has a receiving space therein, of which an operation lever (12) for manipulating the excavator is provided on an upper portion of the console housing;

a safety lever motor (16) which is provided in the console housing (14) to supply a rotational force;

a motor gear (18) which is connected to the safety lever motor (16) to receive the rotational force from the safety lever motor;

a safety lever gear (22) which is connected to the motor gear (18) to receive the rotational force and is provided on one side with a lever spring fixture (20) extending to an outside;

a lever spring (24) which is engaged to the lever spring fixture (20) of the safety lever gear (22) and the console housing (14) at both ends thereof to supply tension;

a cylindrical safety lever cam (28) which is connected to the safety lever gear (22) by a shaft, of which an outer peripheral surface is provided with a cam groove (26);

a pair of first and second sensors (30 and 32) which are installed on the outer peripheral surface of the safety lever cam (28) at a certain interval to detect the cam groove (26) of the safety lever cam (28);

a cylindrical safety lever connecting shaft (34) which is rotatably connected to the safety lever cam (28) and extends in one direction;

a safety lever (36) which is provided on one side of the console housing (14) in the shape of a cantilever to be held by a hand, and is connected to the safety lever connecting shaft (34) at one end thereof;

a plate-shaped sliding stop plate (86) which is provided away from the lower portion of the console housing (14), with an extending side being fixed to the stationary part (10);

a pair of extension plates (88) which are spaced away from each other in a longitudinal direction on an upper portion of the sliding stop plate (86) and extend in an upward direction;

a pair of cylindrical sliding guide rods (90) which are spaced apart from each other, with front and rear portions being respectively fixed to the extension plates (88);

a threaded rod (94) which is rotatably disposed between the sliding guide rods (90) and is provided on an outer peripheral surface thereof with a threaded portion, of which a rear end penetrates the extension plate (88) and extends in a rearward direction, and a gear (92) is engaged to the extended end of the threaded rod;

a plate-shaped slidable plate (100) which is provided on the threaded rods (94) and has on a bottom surface thereof a pair of sliding rods (96) to slidably move along the sliding guide rods, respectively, and a threaded sleeve (98) fastened with the threaded rod (94) to be moved in a longitudinal direction by rotation of the threaded rod between the pair of sliding rods (96);

a console fixture (102) which is engaged to an upper portion of the slidable plate (100) at a lower portion, with an upper portion of the console fixture being extending and engaged to the lower portion of the console housing (14);

a pair of sliding sensors (104) which are spaced apart from each other in the longitudinal direction on the sliding stop plate (86) to detect movement of the slidable plate (100);

a screw motor (108) which is provided below the sliding stop plate (86) to supply a rotational force, and has a gear (92) engaged to a rear end and formed in the shape corresponding to gear (92) of the threaded rod (94) to transfer the rotational force to the gear (92); and a controller (54) which is provided on the console housing (14) and receives signals from the first and second sensors (30 and 32) and the sliding sensors (104), as well as receiving an ON/OFF signal from a power of the excavator, to control the safety lever motor (16) and the screw motor (108).

5. A console box for operating an excavator comprising:

a plate-shaped stationary part (10) which is fixed to a cabin;

a console housing (14) which is disposed on the stationary part (10) to be spaced apart from the stationary part (10), and has a receiving space therein, of which an operation lever (12) for manipulating the excavator is provided on an upper portion of the console housing;

a safety lever motor (16) which is provided in the console housing (14) to supply a rotational force;

a motor gear (18) which is connected to the safety lever motor (16) to receive the rotational force from the safety lever motor;

a safety lever gear (22) which is connected to the motor gear (18) to receive the rotational force and is provided on one side with a lever spring fixture (20) extending to an outside;

a lever spring (24) which is engaged to the lever spring fixture (20) of the safety lever gear (22) and the console housing (14) at both ends thereof to supply tension;

a cylindrical safety lever cam (28) which is connected to the safety lever gear (22) by a shaft, of which an outer peripheral surface is provided with a cam groove (26);

a pair of first and second sensors (30 and 32) which are installed on the outer peripheral surface of the safety lever cam (28) at a certain interval to detect the cam groove (26) of the safety lever cam (28);

a cylindrical safety lever connecting shaft (34) which is rotatably connected to the safety lever cam (28) and extending in one direction;

a safety lever (36) which is provided on one side of the console housing (14) in the shape of a cantilever to be held by a hand, and is connected to the safety lever connecting shaft (34) at one end thereof;

a console lever (58) which protrudes from the operation lever (12) of the console housing (14) in a rearward direction to be held by a hand, of which a lower portion of the console lever (58) extends and penetrates the upper portion of the console housing (14), and is engaged to the console housing by a shaft;

a console lever bar (60) which extends forwardly from the extended lower portion of the console lever (58);

a connecting shaft (64) which is engaged to a front portion of the console lever bar (60) by a hinge, and extends downwardly to penetrate the lower portion of the console housing (14), with the connecting shaft (64) being provided with a connecting bar (62) protruding outwardly within the console housing (14);

a plate-shaped sliding stop plate (86) which is provided away from the lower portion of the console housing (14), with an extending side being fixed to the stationary part (10);

a pair of extension plates (88) which are spaced away from each other in a longitudinal direction on an upper portion of the sliding stop plate (86) and extend in an upward direction;

a pair of cylindrical sliding guide rods (90) which are spaced apart from each other, with front and rear portions being respectively fixed to the extension plates (88);

a pair of sliding springs (110) which are provided on an outer peripheral surface of each sliding guide rod (90) to provide tension;

a plate-shaped latchet plate (112) extending upwardly from an upper portion of the sliding stop plate (86) between the sliding guide rods (90);

a plate-shaped slidable plate (100) which is provided on the sliding guide rods (90), and has a pair of sliding rods (96) which are positioned in front of the sliding spring (110) and are slidably moved on the sliding guide rods (90);

a console fixture (102) which is engaged to an upper portion of the slidable plate (100) at a lower portion, with an upper portion of the console fixture being extending and engaged to the lower portion of the console housing (14);

a solenoid (70) which is engaged to the solenoid support (66), and is provided on an upper portion thereof with a solenoid bar (68) which is slidably moved in a vertical direction;

a plate-shaped movement stopper (116) which is provided on the console fixture (102), of which a rear portion is engaged to the solenoid bar (68) by a hinge, an inner side is engaged to the console fixture (102) by a shaft, and a front lower portion has a movement stopping groove (114) to be locked by the latchet plate (112);

a pair of sliding sensors (104) which are spaced apart from each other in the longitudinal direction on the sliding stop plate (86) to detect movement of the slidable plate (100); and a controller (54) which is provided on the console housing (14) and receives signals from the first and second sensors (30 and 32) and the sliding sensors (104), as well as receiving an ON/OFF signal from a power of the excavator, to control the safety lever motor (16) and the solenoid (70).

* * * * *